US005170654A

United States Patent [19]

Anagnostopoulos

[11] Patent Number: 5,170,654

[45] Date of Patent: Dec. 15, 1992

[54] METHOD FOR WIRE BENDING IN THREE DIMENSIONS

[76] Inventor: Panagiotis A. Anagnostopoulos, 19 Petrou Ralli Street, Athens, Greece, 177 78

[21] Appl. No.: 680,435

[22] Filed: Apr. 4, 1991

[30] Foreign Application Priority Data

Apr. 6, 1990 [GR] Greece ..... 900100269

[51] Int. Cl.[5] ..... B21D 11/14; B21F 7/00

[52] U.S. Cl. ..... 72/299; 72/307; 140/149

[58] Field of Search ..... 72/299, 295, 294, 307, 72/306, 217; 140/149

[56] References Cited

U.S. PATENT DOCUMENTS

| | | | |
|---|---|---|---|
| 731,294 | 6/1903 | Ehrmanntraut | 72/299 |
| 1,272,552 | 7/1918 | Spencer . | |
| 1,438,322 | 12/1922 | Meltz | 72/299 |
| 2,603,269 | 7/1952 | Long | 72/299 |
| 3,052,277 | 9/1962 | Stegman . | |
| 3,202,185 | 8/1965 | Gonia | 72/299 |
| 3,678,723 | 7/1972 | Tenpas | 72/299 |
| 3,857,271 | 12/1974 | Gott et al. . | |
| 4,020,669 | 5/1977 | Gott et al. . | |
| 4,624,121 | 11/1986 | Kitsukawa | 72/299 |
| 4,653,301 | 3/1987 | Meliga . | |
| 4,656,860 | 4/1987 | Orthuber | 72/299 |
| 4,662,204 | 5/1987 | Saegusa . | |
| 4,735,075 | 4/1988 | Saegusa . | |

*Primary Examiner*—Daniel C. Crane

*Attorney, Agent, or Firm*—Cushman, Darby & Cushman

[57] ABSTRACT

Method, applicable to two-dimensional wire bending machines for extension of their operation in bending to form three-dimensional wire frames, which is characterised by the application of a torsional moment along the axis of the wire and before the bending region, causing a permanent plastic deformation of the wire, by twisting it beyond the elastic region, with eventual result any bending action already occured in the regular plane of the two-dimensional bending macnine to be positioned a new plane, which form an angle with the regular plane equal to the remaining due to plastic deformation angle of twist.

8 Claims, 3 Drawing Sheets

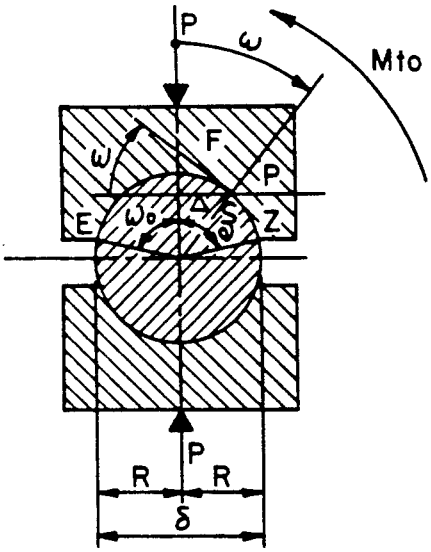
FIG. 3A
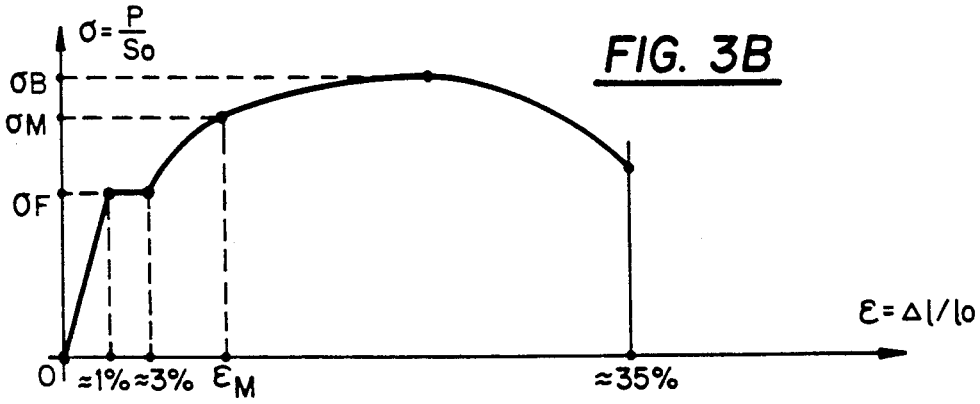
FIG. 3B
(TYPICAL STRESS-STRAIN DIAGRAM OF CARBON-STEEL)
FIG. 3C
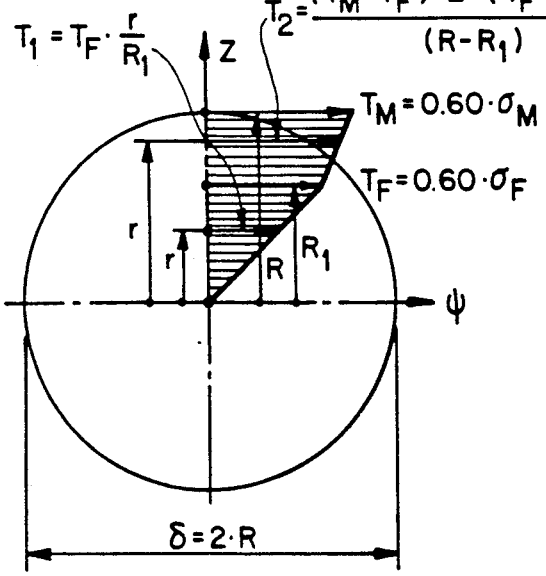
FIG. 3D
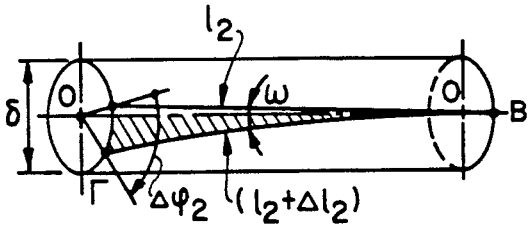

METHOD FOR WIRE BENDING IN THREE DIMENSIONS

The invention refers to a method allowing wire bending machines to form three dimensional wire frames, characterised by the application of a torsion along the axis of the wire, causing a permanent plastic deformation of the wire, by twisting it beyond the yield point.

STATE-OF-THE-ART

The applicant is aware of the following cited references:

| Patent No. | Date | Name |
|---|---|---|
| 1,272,552 | 7/1918 | Spencer |
| 3,052,277 | 9/1962 | Stegman |
| 3,857,271 | 12/1974 | Gott. et al. |
| 4,020,669 | 5/1977 | Gott. et al. |
| 4,662,204 | 5/1987 | Saegusa |
| 4,653,301 | 3/1987 | Meliga |
| 4,735,075 | 4/1988 | Saegusa |

U.S. patent application No. 07/505,682 Anagnostopoulos, filed Apr. 9, 1990, now U.S. Pat. No. 5,088,310, issued Feb. 18, 1992.

The general comments on these inventions are:

There is a great variety of wire bending machines, manually operated, semi-automatic and fully automatic for the formation of two-dimensional plane wire frames. The construction, however, of machines, especially fully automatic, for the formation of three-dimensional wire frames, offers much greater difficulties.

For the formation of three-dimensional wire frames the following methods have been used:

(A) The Bending Head, already used for the formation of two-dimensional wire frames is movable, able to rotate about axis which coincides with the axis of feeding of straightened wire (U.S. Pat. No. 4,735,075).

(B) One additional Bending Head is used, which is placed after the regular Bending Head for the formation of two-dimensional wire frames and which, in the non-operational mode, is placed below the plane of two-dimensional formation of wire frames.

In the operational mode, the additional Bending Head comes out of the plane, engages the wire and bends it at a plane which forms a specific angle with respect to the regular two-dimensional plane of the machine (U.S. Pat. No. 07/505,682).

(C) Instead of rotating the Bending Head about the axis of the wire, the rotation of the wire about its axis. This method assumes the bending of straight portions of wire and usually it is in application, in tube segments (U.S. Pat. No. 4,662,204).

The main problems of these methods for the formation of three-dimensional frames are the following:

(a) The rotation of the Bending Head requires additional complicate mechanisms.

(b) The rotation of the Bending Head sets several restrictions regarding the dimensions and the shapes of the three-dimensional frame to be formed, caused by the space requirements for the rotation of the Head.

(c) If an additional Bending Head is to be used, the resulting disadvantage is the fact that the plane of additional bending is at certain angle with respect to the initial bending plane.

(d) If an additional Bending Head is to be used, additional backward and forward movements of the wire to be bent are required for the application of the additional Bending Head at the exact point on the wire. In practice, the two Bending Heads are placed at a specific unaltered distance one from the other. If the wire is to be bent by the two heads, alternatively, at two points of distance less than the distance of the two bending heads, additional movements are required for the application of the Bending Heads at the exact points.

(e) If additional Bending Head is to be used, the regular plane for the two-dimensional wire frames formation sets restriction in the shapes of 3-d frames to be formed. This plane allows the additional Bending Head to bend between 0° and 180° only, while the regular Bending Head is allowed to bend from −180° to +180°.

(f) Finally, the additional Bending Head requires complicate mechanisms for its exit and entrance out and in the regular Bending plane.

THE PRESENT INVENTION

It offers a very simple method for the formation of three-dimensional wire frames by already existing two-dimensional, plane, Bending Machines. The method uses for the formation of three-dimensional wire frames, as additional elaboration of the wire, the "torsion" and not the "bending" of the wire already used by common three-dimensional Wire Bending Machines.

For the formation, in the present invention, of the third dimension shape, the wire is not bent in the plane of this third dimension, either by means of an additional Bending Head or by means of rotation of already existing Bending Head, but rather after its regular two-dimensional plane bending the wire is forced to twist by an additional torsional mechanism, about its initial straight axis, at an angle of twist exceeding its yield point strain. A permanent plastic deformation is caused, in such a way that the already applied bending action to refer to plane at angle equal to twisting, remaining plastic deformation, angle. The applied torsion on the wire is of such value that the remaining after plastic deformation, angle of twist, corresponds to angle of the additional bending plane.

The resulting advantages of the present method are the following:

(a) The mechanism for the application of torsion is very simple and does not require complicate or combined operations.

(b) It does not set any restriction in the formed three-dimensional wire frame because it is placed before the Bending Head at the straight portion of the wire.

(c) The angle of the additional bending plane may be arbitrary.

(d) No additional forward and backward movements of the wire are required for the application of the Bending Heads at the exact points.

(e) No additional mechanism is required to exit and enter the additional Bending Head from the regular bending plane. In fact, the mechanism for the application of the torsion is permanently installed below the bending plane.

(f) The predetermination of applied torsion is easy, allowing the programming of torsion as well as bending actions with result in ability of process automation.

BRIEF DESCRIPTION OF THE DRAWINGS

A preferred embodiment is described below with references to cited figures.

FIG. 3A-D illustrate the theories of forces and deformations in torsion in accordance with the invention.

DETAILED DESCRIPTION OF THE PREFERRED EMBODIMENT

Figure 1:
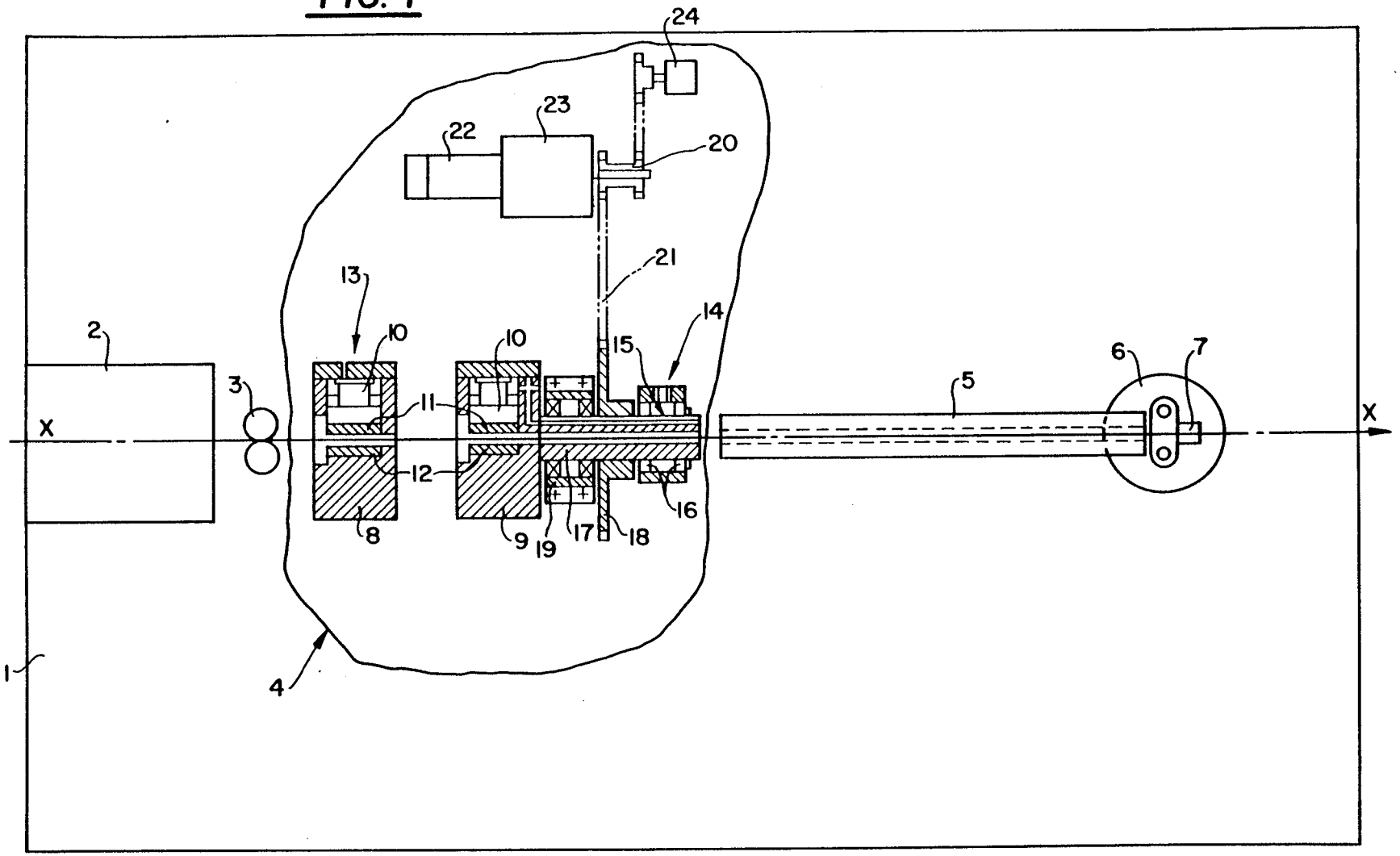
FIG. 1 is a plan view of an automatic bending machine for forming a two-dimensional wire frame from a boil of wire with a torsional action mechanism, in accordance with the present invention, mounted of the bending mechanism.

The plane (1) which coincides with the figure plane, is the regional bending plane for 2-D or plane wire frames and represents the plate of bending of a 2-D Bending Machine.

The wire enters the machine from the left and moves to the right following the axis X—X until the Bending Head (6). Mechanism (2) straightens the wire. Mechanism (3) measures the length of the wire as it is progressed. Mechanism (4) applies the torsion on the wire, which is used for the formation of three-dimensional wire frames, in a way described below. Wire guide (5) guides the wire to the Bending Head (6), which Head bends the wire on plate (1). The cutter (7) is used for cutting of the ready wire frame out of the advancing wire from coil.

For the formation of a plane frame (i.e. of H shape) the following consecutive progressions, by mechanism (2), and bendings, by Bending Head (6), are required: progression of predetermined length—bending at specific angle—additional progression of predetermined length—additional bending at specific angle.

If, at the end of the additional progression and before the additional bending, the wire is forced to a torsion by mechanism (4), in a direction forcing the already formed frame to move away from plate (1), then the additional bending will create a frame not on the plane of the machine but a three-dimensional one.

The description of the mechanism for the application of the "torsion" (Mechanism 4) follows: The basic parts of the mechanism are the immovable gripper (8) and the rotating gripper (9) of the wire. In both grippers the hydraulic pistons (10) press the movable jaws (11) on immovable jaws (12) forcefully engaging the wire between them. The jaws are of selected length and of semi-cylindrical cross-section in such a way that no transverse normal plastic deformation to occur at the surface of the wire during the gripping action.

The hydraulic fluid enters the pistons by the steady tube through the hole (13). In the rotating gripper (9) the hydraulic fluid comes with steady tube to hole (14) and fills the cylindrical space (15) which seals with the two sealing rings (16). Finally through the hole (17) it arrives to piston (10). The rotating gripper rotates by means of sprocket (18), being supported on bushing (19). The sprocket (18) is driven by sprocket (20) through chain (21).

The sprocket (18) is driven by servomotor (22) and gear train speed reducer (23), the rotation angle of which is measured by rotary encoder (24). The rotary encoder (24) measures that way, by suitable scaling, the rotation angle of gripper (9). For the rotation of gripper (9), another means may be used as for example rack and pinion connection, where rack may replace sprocket (18). The torsional action of mechanism (4) will be described below since the operation of a 2-D Bending Machine is considered as known state-of-the-art.

Assume that movable (11) and immovable (12) jaws compress adequately the wire between them, as a result of applied hydraulic pressure on pistons.

Figure 2:
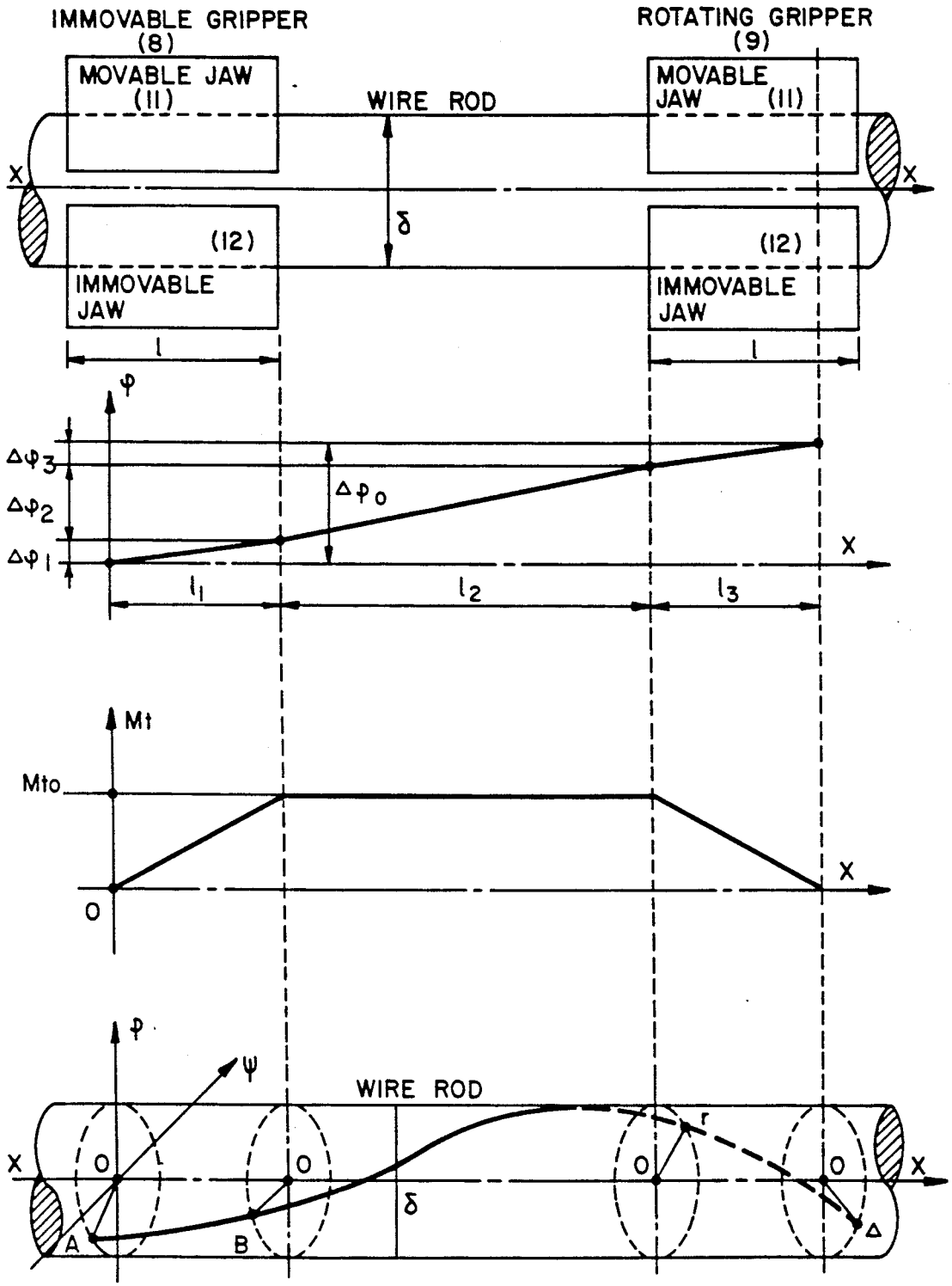
FIG. 2 is a schematic view of the lengths and angles of torsional effect on a wire in accordance with the invention.

Assume that the rotating gripper (9) rotates at an angle $\Delta\phi_o$, with respect to immovable gripper (8). Then, an outer generic straight line of the cylindrical surface of the wire will receive a helical shape ABΓΔ (FIG. 2) of angle between bound radii OA and OΔ equal to $\Delta\phi_o$. Let l be the total length of the jaws. The wire is acted gradually by the torsional moment excerted by the jaws, through its surface friction. Let l1 be the required length for total torsional moment $M_{to}$ to be excerted on wire. Naturally $l1 << l$. That way, the total angle of twist $\Delta\phi_o$ may be divided into three portions, referring created 3 helix of an outter generic straight line of the cylindrical surface of the wire:

Angle of twist $\Delta\phi_1$ on length l1.

Angle of twist $\Delta\phi_2$ on free length l2.

Angle of twist $\Delta\phi_3$ on length l3.

We are allowed to assume for geometrically identical jaws of equally applied hydraulic pressure that:

$$l1 = l3$$

Assuming perfect contact of jaws and outter surface of the wire, then applied force P on jaws (FIG. 3*a*) creates a uniform contact pressure P, according to the relation:

$$P = \int_{-W_o}^{W_o} l1 \cdot p \cdot \cos w ds = p \cdot l1 |\epsilon 1| \approx p \cdot \delta \cdot l1 \quad (1)$$

For the applied torsional moment, if $\mu$ is the coefficient of static friction, the following relation holds:

$$M_{to} = 2 \int_{-W_o}^{tW_o} \int_{o}^{l_1} \frac{\delta}{2} \cdot p \cdot \mu dl_1 \cdot ds = p \cdot \delta \cdot \mu |\epsilon z| \cdot l_1 = \quad (2)$$

$$\frac{\pi}{2} \cdot \mu \cdot p \cdot l_1 \delta^2 \; o = [according\ to\ (1)] = \frac{\pi}{2} \mu \cdot P \cdot \delta$$

To determine twisting angles $\Delta\phi_1$, $\Delta\phi_2$, $\Delta\phi_3$, the external load - external deformation relations, valid for torsion in elastic region $$\Delta_6 = (M_T l)/(T_p \cdot G)$$

cannot be used since the developing stress exceeds the yield point. Actually, the developing stress in outter portions of the wire varies between the yield stress $\sigma_B$ and ultimate stress (corresponding to rapture) $\sigma_F$. Assuming that equivalent shearing stress is connected to normal stress with the relation:

$$z = \frac{1}{\sqrt{3}} \cdot 6 = 0.66 \quad (3)$$

for rod heavily loaded in torsion, we assume within an accuracy level, that the shearing stress varies linerarly from the center of wire rod to some radius $R_1$ (FIG. 3-γ) from 0 (zero) to the value $\tau_F$ and from there again linearly to external radius R from value $\tau_F$ to $\tau_M$.

The required torsional moment is given by the relation:

$$M_{to} = \int_{o}^{R_1} T_1 \cdot 2\pi r^2 \cdot dr + \int_{R_1}^{R_2} \tau_2 2\pi r^2 dr = \quad (4)$$

-continued $$\frac{\pi}{2}\tau_F R_1^3 + \frac{\pi}{2}(\tau_M - \tau_F)\frac{(R^4 - R_1^4)}{(R - R_1)} +$$

$$\frac{2\pi}{3}\ \frac{(\tau_F \cdot R - \tau_M R_1)}{(R - R_1)}(R^3 - R_1^3)$$

equation (3) for steel, heavily loaded in torsion is as follows:

$$6_F \approx 0.75\ 6_B,\quad \tau_F \approx 0.60\ 6_F = 0.45\ 6_B \tag{5}$$

$$6_M = 0.90\ 6_B\quad \tau_M \approx 0.60\ 6_F = 0.54\ 6_B$$

$$R_1 << R \rightarrow\quad \tau_M \approx 1.2T_F,\ M_{lo}\,(\max) = 1.53 \cdot \frac{\pi}{2} \cdot \tau_F \cdot R^3$$

which is 53% higher than the required $M_{lo}$ to set outter shearing stress to value $\tau_F$.

$$(\tau_1 = \tau_F, \text{ for } R_1 = R),\ M_{lo} = \frac{\pi}{2} \cdot \tau_F \cdot R^3 \tag{6}$$

In FIG. 3-δ, the corresponding picture for the determination of the relation between twisting angle $\Delta_{\phi 2}$ and length $1_2$ for a given required of wire rod:

$$\epsilon_2 = \Delta l_2 / l_2$$

Taking into account that twisting angle in elastic range is negligible against the twisting angle in plastic region, and the fact that the volume of the wire rod remains constant, we have:

$$l_2 = R \cdot \Delta\phi_2(\text{rad})/\tan\omega, \text{ and}$$

$$\cos\omega = \frac{l_2}{(l_2 + \Delta l_2)} = \frac{1}{(1 + \epsilon_2)}$$

Eliminating angle w and expressing $\Delta\phi_2$ in degrees we receive:

$$\left(\frac{l_2}{\delta}\right) = \frac{\Delta\phi_2(^\circ)}{114.6\sqrt{\epsilon_2 \cdot (2 + \epsilon_2)}}$$

That way, we determine the dimension $1_2$ in connection with diameter of wire for given twisting angle $\Delta\phi_2$ in degrees for desired outter normal strain $\epsilon_2$ of wire.

For example for $\Delta\phi_2 = 90^\circ$ and $\epsilon_2 = 10\% = 0.1$ $$\frac{l_2}{\delta} = \frac{g_o}{114.6\sqrt{0.10(2 + 0.14)}} = 1.\phi 1$$

I claim:

1. A method of bending wire into a three-dimensional shape comprising:

providing a continuous coil or wire;

providing a bending apparatus comprising means for straightening wire fed to the apparatus from a said coil; a non-rotatable gripper for selectively grippingly engaging wire received from said means for straightening to thereby prevent rotation thereof about a longitudinal axis thereof; a rotatable gripper for selectively grippingly engaging wire received from said non-rotatable gripper; means for selectively rotating said rotatable gripper while said rotatable gripper is gripping said wire to thereby permanently twist said wire through a predetermined angle about said longitudinal axis; and a bending mechanism for selectively bending wire received from said rotatable gripper in a two-dimensional plane;

feeding wire from said wire coil through said bending apparatus;

straightening the wire fed form said wire coil;

selectively bending said wire in a two-dimensional plane with said bending mechanism to thereby form a first bent segment of wire;

gripping said wire with said non-rotatable gripper and with said rotatable gripper upstream of said first bent segment; and rotating said rotatable gripper after said bending step and during said gripping step to thereby twist the wire downstream of said non-rotatable gripper therethrough to rotate said first bent segment through an angle corresponding to the angle of twist of the wire, said step of providing an apparatus including a non-rotatable gripper and a rotatable gripper includes providing grippers which each comprise a stationary jaw and a movable jaw and wherein said step of gripping said wire comprises moving said movable jaw towards said stationary jaw to grip the wire therebetween.

2. A method as in claim 1, further comprising the step of bending the wire with said bending means after said step of rotating thereby to form a wire bent in three dimensions.

3. A method as in claim 1, further comprising the step of pressing the wire between said movable jaw and said stationary jaw with hydraulic pistons to which hydraulic fluid is selectively delivered.

4. A method of bending wire into a three-dimensional shape comprising:

providing a continuous coil or wire;

providing a bending apparatus comprising means for straightening wire fed to the apparatus from a said coil; a non-rotatable gripper for selectively grippingly engaging wire received from said means for straightening to thereby prevent rotation thereof about a longitudinal axis thereof; a rotatable gripper for selectively grippingly engaging wire received from said non-rotatable gripper; means for selectively rotating said rotatable gripper while said rotatable gripper is gripping said wire to thereby permanently twist said wire through a predetermined angle about said longitudinal axis; and a bending mechanism for selectively bending wire received from said rotatable gripper in a two-dimensional plane;

feeding wire from said wire coil through said bending apparatus;

straightening the wire fed from said wire coil;

selectively bending said wire in a two-dimensional plane with said bending mechanism to thereby form a first bent segment of wire;

gripping said wire with said non-rotatable gripper and with said rotatable gripper upstream of said first bent segment; and rotating said rotatable gripper after said bending step and during said gripping step to thereby twist the wire downstream of said non-rotatable gripper therethrough to rotate said first bent segment through an angle corresponding to the angle of twist of the wire, said step of providing an apparatus including a rotatable gripper comprises providing rotatable gripper which is operatively coupled to a sprocket supported on a bushing, said sprocket being driven by a second sprocket connected to a servomotor and a gear train speed reducer and said step of rotating comprises driving said sprocket with said second sprocket to thereby rotate said rotatable gripper.

5. A method as in claim 1, further comprising measuring an angle of rotation of said gear with a rotating angle sensor.

6. A method of bending wire into a three-dimensional shape comprising:

providing a continuous coil or wire;

providing a bending apparatus comprising means for straightening wire fed to the apparatus from a said coil; a non-rotatable gripper for selectively grippingly engaging wire received from said means for straightening to thereby prevent rotation thereof about a longitudinal axis thereof; a rotatable gripper for selectively grippingly engaging wire received from said non-rotatable gripper; means for selectively rotating said rotatable gripper while said rotatable gripper is gripping said wire to thereby permanently twist said wire through a predetermined angle about said longitudinal axis; and a bending mechanism for selectively bending wire received from said rotatable gripper in a two-dimensional plane;

feeding wire from said wire coil through said bending apparatus;

straightening the wire fed from said wire coil;

selectively bending said wire in a two-dimensional plane with said bending mechanism to thereby form a first bent segment of wire;

gripping said wire with said non-rotatable gripper and with said rotatable gripper upstream of said first bent segment; and rotating said rotatable gripper after said bending step and during said gripping step to thereby twist the wire downstream of said non-rotatable gripper therethrough to rotate said first bent segment through an angle corresponding to the angle of twist of the wire, said step of rotating said rotatable gripper comprises providing a servomotor having a rack and pinion connected thereto and operatively coupled to said rotatable gripper and rotating said rotatable gripper therewith.

7. A method of bending wire into a three-dimensional shape comprising:

providing a continuous coil or wire;

providing a bending apparatus comprising means for straightening wire fed to the apparatus from a said coil; a non-rotatable gripper for selectively grippingly engaging wire received from said means for straightening to thereby prevent rotation thereof about a longitudinal axis thereof; a rotatable gripper for selectively grippingly engaging wire received from said non-rotatable gripper; means for selectively rotating said rotatable gripper while said rotatable gripper is gripping said wire to thereby permanently twist said wire through a predetermined angle about said longitudinal axis; and a bending mechanism for selectively bending wire received from said rotatable gripper in a two-dimensional plane;

feeding wire from said wire coil through said bending apparatus;

straightening the wire fed from said wire coil;

selectively bending said wire in a two-dimensional plane with said bending mechanism to thereby form a first bent segment of wire;

gripping said wire with said non-rotatable gripper and with said rotatable gripper upstream of said first bent segment; and rotating said rotatable gripper after said bending step and during said gripping step to thereby twist the wire downstream of said non-rotatable gripper therethrough to rotate said first bent segment through an angle corresponding to the angle of twist of the wire, said step of providing an apparatus comprising providing grippers which are spaced a part a distance $l_2$ which is determined by the formula:

$$\frac{l_2}{\delta} = \frac{\Delta\phi_2(^\circ)}{114.6\sqrt{\epsilon_2 \cdot (2 + \epsilon_2)}}$$

where $\delta$ = the diameter of the wire $\Delta\phi_2$ in degrees (°) = desired twisting angle $\epsilon_2$ = maximum allowable normal strain exerted on the wire.

8. A method as in claim 2, further comprising the step of bending the wire with said bending means after said step of rotating thereby to form a wire bent in three dimensions.

* * * * *